US007730806B1

(12) United States Patent
Grimaldi

(10) Patent No.: US 7,730,806 B1
(45) Date of Patent: Jun. 8, 2010

(54) VEHICLE PEDAL BOOSTER AND ASSOCIATED METHOD

(76) Inventor: Stanzie Grimaldi, 65 Portuguese Bend Rd., Rolling Hills, CA (US) 90274

( * ) Notice: Subject to any disclaimer, the term of this patent is extended or adjusted under 35 U.S.C. 154(b) by 0 days.

(21) Appl. No.: 11/978,057

(22) Filed: Oct. 29, 2007

(51) Int. Cl.
*G05G 1/48* (2008.04)

(52) U.S. Cl. ..... 74/562

(58) Field of Classification Search ..... 74/561, 74/562, 564
See application file for complete search history.

(56) References Cited

U.S. PATENT DOCUMENTS 3,626,785 A * 12/1971 Ross ..... 74/512
6,367,348 B1 4/2002 Toelke
6,367,349 B1 4/2002 Allen
6,584,871 B2 7/2003 Burton
2007/0072752 A1 * 3/2007 Koch et al. ..... 482/121

* cited by examiner

*Primary Examiner*—Thomas R Hannon
*Assistant Examiner*—Phillip Johnson

(57) ABSTRACT

A vehicle pedal booster includes a rigid support panel with a rectilinear central region provided with a predetermined thickness and a plurality of anchoring brackets spaced from the support panel and positioned posterior thereof in such a manner that the existing vehicle pedal is intercalated between the anchoring brackets and the support panel. The apparatus further includes a mechanism for maintaining the anchoring brackets and the support panels directly and statically abutted against the existing pedal such that the vehicle pedal booster is prohibited from disengaging the existing vehicle pedal during driving conditions. Such a maintaining mechanism includes a plurality of rectilinear threaded fasteners penetrating through the orifices and engaging the anchoring brackets respectively.

11 Claims, 4 Drawing Sheets

VEHICLE PEDAL BOOSTER AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to pedal boosters and, more particularly, to a vehicle pedal booster for assisting a driver of a vehicle to reach an existing vehicle pedal during driving conditions.

2. Prior Art

Everyday, millions of Americans climb into their cars, trucks or minivans and make their way across the highways and byways of this great land. Whether a retired couple embarking on a cross country journey, a college coed enduring a long commute to school, or a busy homemaker driving a few blocks to the neighborhood grocer, automobiles offer consumers a simple way in which to get from one place to another, both safely and easily. Perhaps the greatest invention of modern history, the introduction of the automobile is often attributed to Henry Ford in the year 1896. However, the concept and prototype for both an internal combustion and steam engine vehicle, was developed years earlier.

Regardless of when the first automobile made its way onto American roads, it is safe to say that this revolutionary product vastly changed the landscape of our country and as quickly as those early production models came off of the assembly line they were snapped up by a populace eager to experience the freedom of mobility that this new form of transportation afforded. Initially there was little concern for safety devices to be incorporated into the design of automobiles. However, as the number of roads, cars and drivers multiplied, so did the number of automobile accidents, until the point that the federal government determined a need to require automobile manufacturers to begin designing safer cars. One of the most important safety features mandated by government into the manufacture of every new automobile produced was the safety belt.

There is little doubt that the safety belt has saved thousands of lives since they were required as standard equipment. Today, of course, the air bag is the darling of the automobile safety front. Used in conjunction with safety belts, air bags are the next big step into driver and passenger automobile safety. Although air bags do not have the long history of usage and accident prevention that seat belts enjoy, there is much evidence to support their overall effectiveness.

While air bags certainly work to save lives endangered by automobile collisions, there are many drawbacks associated with their use. Foremost is the force and speed of air bag inflation. While speedy air bag inflation is key to protecting the car's occupants when a collision occurs, there have been various reports of injuries occurring to drivers and passengers simply as a result of the air bag deployment itself, and not from the collision. To this end, the National Transportation Safety Board has determined that infants in restraint seats are to be belted down facing backwards in order to avoid possible injuries from rapidly inflating air bags. They also determined that many of the air bag injuries to adults were caused from sitting too close to the point of air bag deployment.

This is unfortunate news for people of shorter stature, who have no option other than to bring their seat fully forward in order to reach the foot pedals and drive the vehicle. In addition to the dangers presented by air bags, sitting too close to the steering wheel can be extremely uncomfortable for the driver. Simply stated, comfortably maneuvering a steering wheel when sitting mere inches away can be a nearly impossible endeavor. Unfortunately, these are challenges people of shorter stature must deal with on a regular basis. Obviously, it would be advantageous to provide a means for allowing persons of short stature to reach automobile foot pedals while maintaining a safe and comfortable distance from the steering wheel.

U.S. Pat. No. 6,367,348 to Toelke discloses an adjustable control pedal for a motor vehicle that includes a first member having a slot formed therein. A pin laterally extends into the slot and has an abutment facing the first member on a side of the first member opposite the second member, and a second member is rigidly secured to the pin and movable relative to the first member along the slot. A plastic bushing encircles the pin and extends into the slot. The bushing has a flange engaging the first member on a side of the first member opposite the second member. A plastic washer encircles the pin and is located between the first and second members. A spring washer such as a wave or Belleville washer is located between the abutment and the flange and resiliently biases the second member relative to the first member to resist relative lateral movement between the first and second members to reduce lash therebetween. The pin can be either a guide pin or a drive pin of the control pedal. Various embodiments are disclosed wherein the first and second members are upper and lower pedal arms respectively and are a mounting bracket and an upper pedal arm respectively. Unfortunately, this prior art example is complicated to install and therefore requires professional installation.

U.S. Pat. No. 6,367,349 to Allen discloses an adjustable control pedal for a motor vehicle that includes a pivotable upper pedal arm having an arcuate slot formed therein. A link is pivotable relative to the upper pedal arm, and a lower pedal arm has an upper end pivotably connected to the link and a lower end carrying a pedal. A drive assembly includes a screw supported by the upper pedal arm, and a motor is operatively connected to the screw to selectively rotate the screw. A nut threadably engages the screw and adapts to move along the screw upon rotation of the screw. The nut is pivotally connected to the link such that the link pivots relative to the upper pedal arm upon movement of the nut along the screw. A pin connects to the lower pedal arm and laterally extends into the slot such that the pin moves along the slot upon pivotal movement of the link. Also disclosed is a control pedal having a drive block or a pair of spaced apart pins located in a single slot of the upper pedal arm. Unfortunately, this prior art example is complicated to install and therefore requires professional installation.

U.S. Pat. No. 6,584,871 to Burton discloses an adjustable pedal assembly for a vehicle that includes an adjustment bracket adapted for mounting on a vehicle, and the adjustment bracket includes a pair of outwardly extending side portions having a vertically extending arcuate slot. The adjustable pedal assembly also includes a pedal arm pivotally attached to the adjustment bracket using a pivot pin, such that an end of the pivot pin is slidably disposed within the arcuate slot in the adjustment bracket. The adjustable pedal assembly further includes a pedal pad mounted to the pedal arm, and a pedal adjustment mechanism operatively attached to the pedal arm for adjusting the position of the pedal arm along a predetermined path such that the pivot pin is slidably positioned in the arcuate slot relative to the predetermined path of the pedal arm to ergonomically position the pedal pad. Unfortunately, this prior art example is not designed to be installed and removed as needed by multiple drivers.

Accordingly, the present invention is disclosed in order to overcome the above noted shortcomings. The present invention satisfies such a need by providing an assembly that is convenient and easy to use, lightweight yet durable in design, and designed for assisting a driver of a vehicle to reach an existing vehicle pedal during driving conditions. Such an adapter assembly enables consumers of short stature to comfortably reach their vehicle's foot pedals, without compromising comfort when driving. By enabling the consumer to move the vehicle seat further away from the steering wheel once the adapter is installed, the driver is placed in a much safer driving position in relation to the driver's side air bag. In this manner, the event of air bag deployment provides the consumer with all of the positive safety benefits that air bags offer, while greatly reducing any negative potential. The present invention is simple to use, inexpensive, and designed for many years of repeated use.

BRIEF SUMMARY OF THE INVENTION

In view of the foregoing background, it is therefore an object of the present invention to provide an assembly for assisting a driver of a vehicle to reach an existing vehicle pedal during driving conditions. These and other objects, features, and advantages of the invention are provided by a vehicle pedal booster.

A vehicle pedal booster includes a rigid support panel with a rectilinear central region provided with a predetermined thickness. Such a support panel further has a corrugated top surface provided with a plurality of juxtaposed linear ridges traversing a longitudinal length of the top panel, and the body further has a plurality of flanges monolithically formed with the support panel and situated at opposed corners thereof respectively. Each of such flanges has an axial orifice formed therein and effectively spanning through an entire thickness of the associated flanges. The top surface of the support panel is formed from rubber material for preventing a user's foot from slipping off of the support panel.

The assembly further includes a plurality of anchoring brackets spaced from the support panel and positioned posterior thereof in such a manner that the existing vehicle pedal is intercalated between the anchoring brackets and the support panel. Each of such anchoring brackets and the support panel conveniently have a surface provided with a plurality of protrusions extending outwardly therefrom for providing an increased surface area against which the existing vehicle pedal is engaged. Each of the anchoring brackets advantageously has planar top surfaces directly abutted against a bottom surface of the existing vehicle pedal. The anchoring brackets have corresponding longitudinal lengths registered parallel to a bottom surface of the support panel. Each of the anchoring brackets is independently adaptable along a corresponding rectilinear path defined along respective longitudinal lengths of the fasteners such that the vehicle pedal booster maintains direct contact with the existing vehicle pedal.

The assembly further includes a mechanism for maintaining the anchoring brackets and the support panels directly and statically abutted against the existing pedal such that the vehicle pedal booster is prohibited from disengaging the existing vehicle pedal during driving conditions. Such a maintaining mechanism effectively includes a plurality of rectilinear threaded fasteners penetrating through the orifices and engaging the anchoring brackets respectively. Each of such fasteners is registered orthogonally to respective longitudinal lengths of the anchoring brackets and the support panel such that the anchoring brackets remain fixedly spaced and juxtaposed posterior to the support panel and the existing vehicle pedal respectively.

A method for assisting a driver of a vehicle to reach an existing vehicle pedal during driving conditions includes the step of providing a rigid support panel has a rectilinear central region has a predetermined thickness. Such a support panel further has a corrugated top surface provided with a plurality of juxtaposed linear ridges traversing a longitudinal length of the top panel, and the body further has a plurality of flanges monolithically formed with the support panel and situated at opposed corners thereof respectively. Each of such flanges has an axial orifice formed therein and spanning through an entire thickness of the associated flanges.

The steps further include: spacing a plurality of anchoring brackets from the support panel by positioning the anchoring brackets posterior of the support panel in such a manner that the existing vehicle pedal is intercalated between the anchoring brackets and the support panel; and maintaining the anchoring brackets and the support panels directly and statically abutted against the existing pedal such that the vehicle pedal booster is prohibited from disengaging the existing vehicle pedal during driving conditions.

The method further includes the step of penetrating a plurality of rectilinear threaded fasteners through the orifices and engaging the anchoring brackets respectively. Each of such fasteners is registered orthogonally to respective longitudinal lengths of the anchoring brackets and the support panel such that the anchoring brackets remain fixedly spaced and juxtaposed posterior to the support panel and the existing vehicle pedal respectively.

The method further includes the steps of: engaging a plurality of protrusions of each of the anchoring brackets and the support panel with the existing vehicle pedal; and directly abutting a planar top surface of each of the anchoring brackets against a bottom surface of the existing vehicle pedal. The anchoring brackets have corresponding longitudinal lengths registered parallel to a bottom surface of the support panel.

The method further includes the steps of: independently adapting each of the anchoring brackets along a corresponding rectilinear path defined along respective longitudinal lengths of the fasteners such that the vehicle pedal booster maintains direct contact with the existing vehicle pedal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
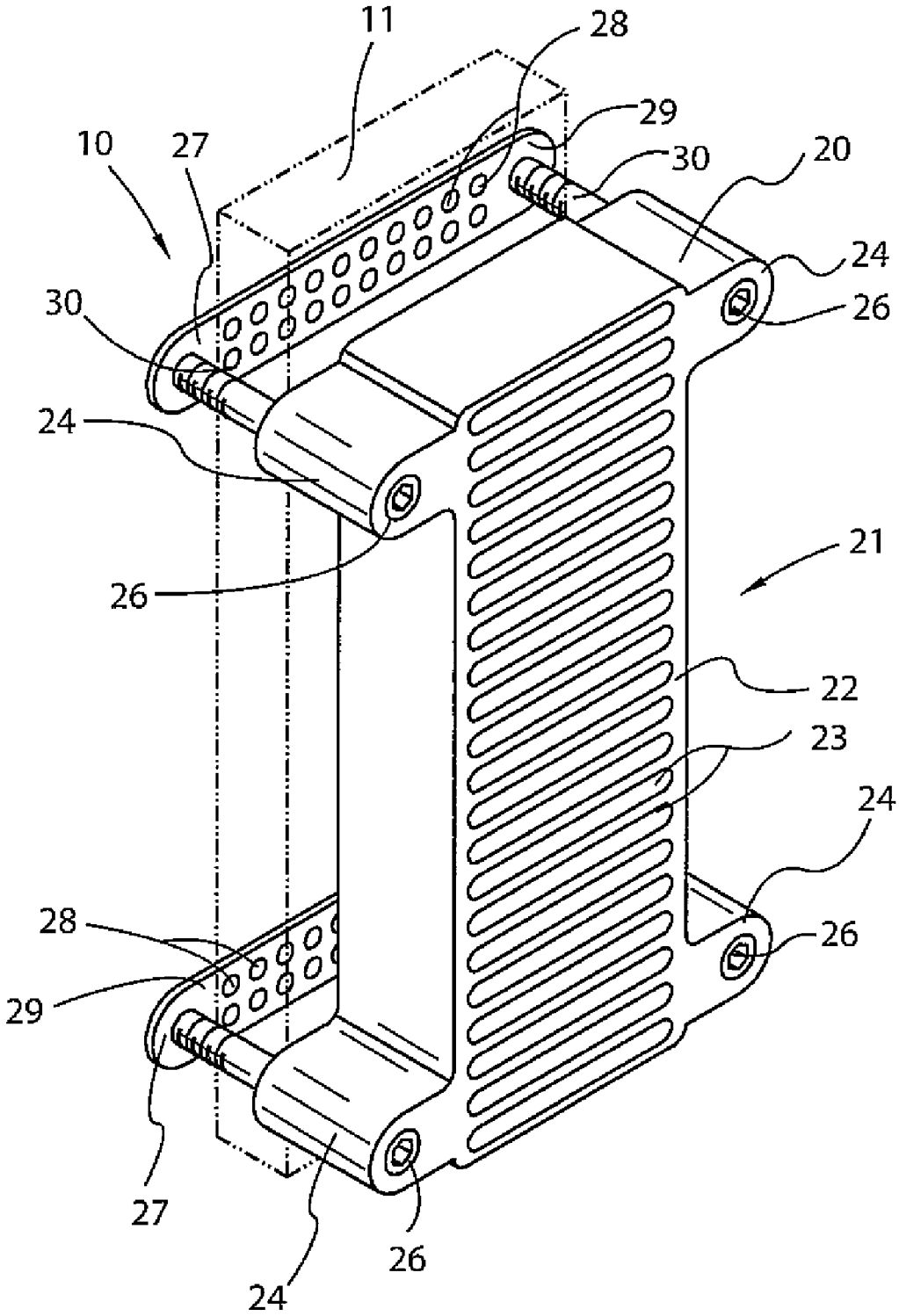
FIG. 1 is a perspective view showing a vehicle pedal booster, in accordance with the present invention.
Figure 2:
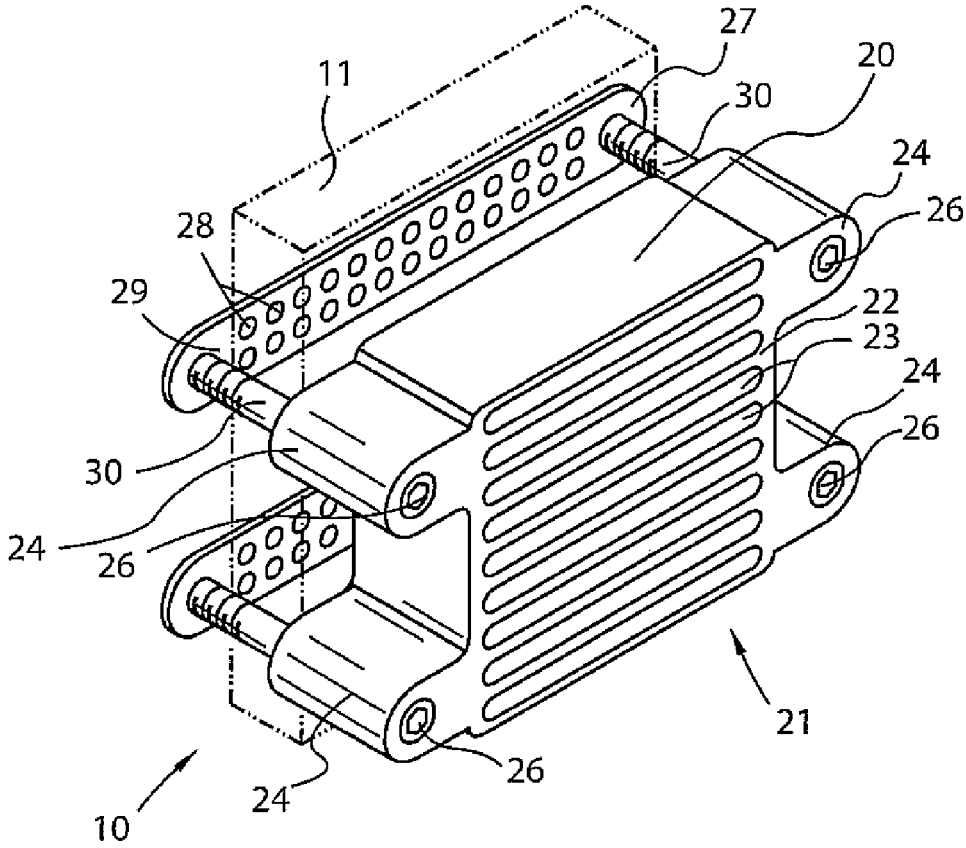
FIG. 2 is a perspective view showing an alternatively sized vehicle pedal booster, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-6 by the reference numeral 10 and is intended to protect a vehicle pedal booster. It should be understood that the assembly 10 may be used to boost many different types of pedals and should not be limited to boosting only those types of pedals mentioned herein.

Referring to FIGS. 1, 2, 4, 5 and 6, a vehicle pedal booster includes a rigid support panel 20 with a rectilinear central region 21 provided with a predetermined thickness. Such a support panel 20 further has a corrugated top surface 22 provided with a plurality of juxtaposed linear ridges 23 traversing a longitudinal length of the top panel 22, and the body further has a plurality of flanges 24 monolithically formed with the support panel 20 and situated at opposed corners thereof respectively. Each of such flanges 24 has an axial orifice 26 formed therein and spanning through an entire thickness of the associated flanges 24. The top surface 22 of the support panel 20 is formed from rubber material for preventing a user's foot from slipping off of the support panel 20. The support panel 20 may be available in different thicknesses and sizes in order to accommodate the needs of different users. The support panel 20 may be thicker for shorter individuals, and may also come in different sizes to fit different sizes of vehicle pedals.

Referring again to FIGS. 1, 2, 4, 5 and 6, the assembly 10 further includes a plurality of anchoring brackets 27 spaced from the support panel 20 and positioned posterior thereof in such a manner that the existing vehicle pedal is intercalated between the anchoring brackets 27 and the support panel 20. Each of such anchoring brackets 27 and the support panel 20 have a surface provided with a plurality of protrusions 28 extending outwardly therefrom for providing an increased surface area against which the existing vehicle pedal is engaged. Each of the anchoring brackets 27 has planar top surfaces 29 directly abutted, without the use of intervening elements, against a bottom surface of the existing vehicle pedal 11. The anchoring brackets 27 have corresponding longitudinal lengths registered parallel to a bottom surface of the support panel 20. Each of the anchoring brackets 27 is independently adaptable along a corresponding rectilinear path defined along respective longitudinal lengths of the fasteners 30 which is essential such that the vehicle pedal booster maintains direct contact with the existing vehicle pedal. The plurality of protrusions 28 ensure that the anchoring brackets 27 remain fixedly engaged with the existing vehicle pedal 11.

Figure 3:
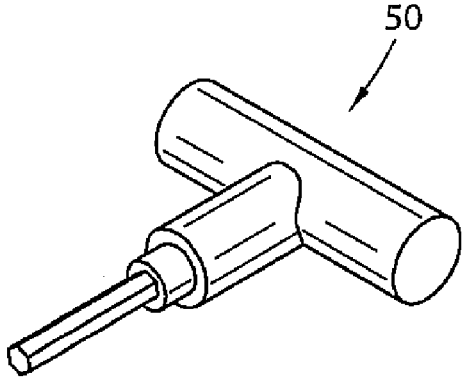
FIG. 3 is a perspective view showing a mechanism for adjusting the rectilinear threaded fasteners, in accordance with the present invention.
Figure 4:
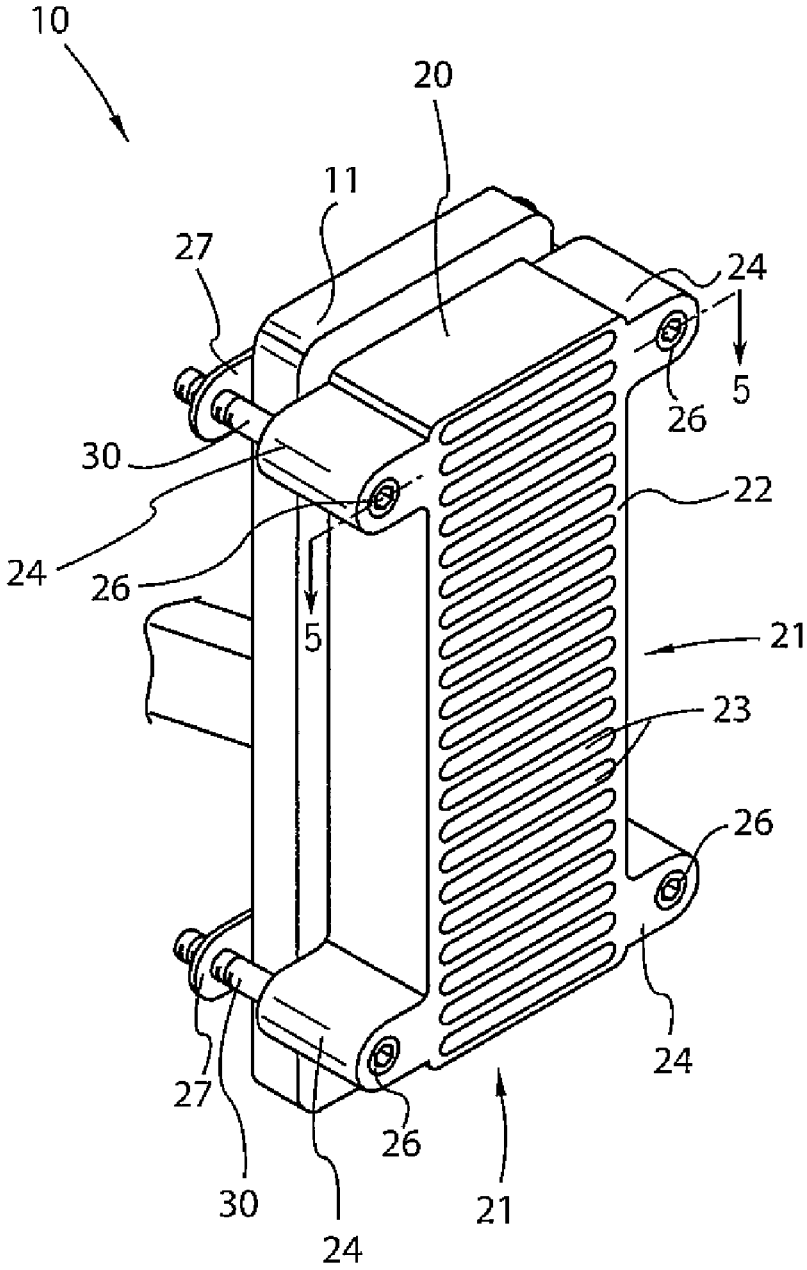
FIG. 4 is a perspective view showing an alternatively sized vehicle pedal booster, in accordance with the present invention.
Figure 5:
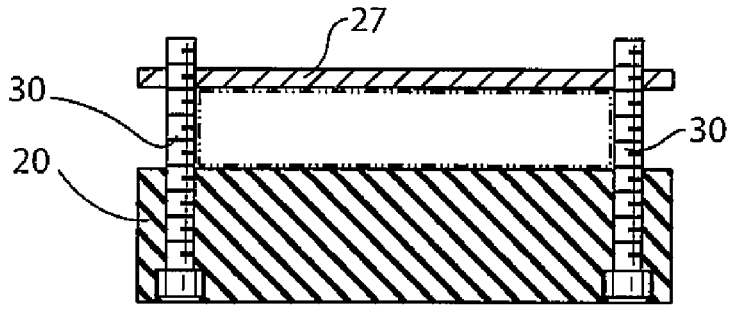
FIG. 5 is a cross sectional view, taken along line 5-5, as seen in FIG. 4.
Figure 6:
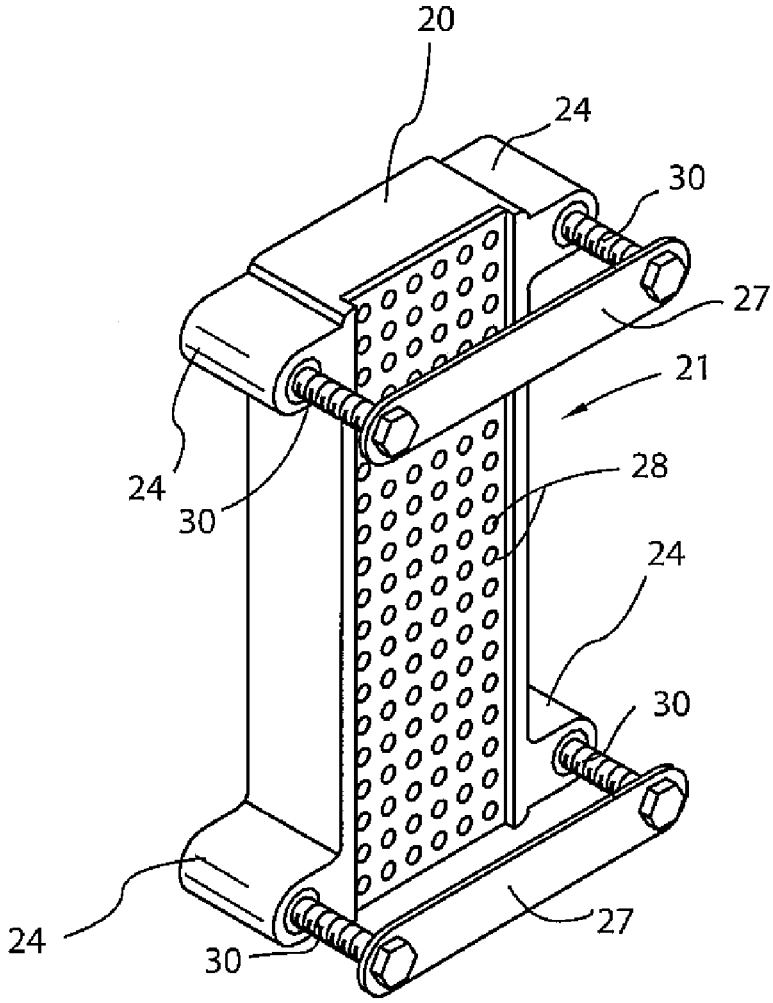
FIG. 6 is a perspective view of a vehicle pedal booster, as shown in FIG. 4, showing the back plane of the present invention.

Referring again to FIGS. 1, 2, 4, 5 and 6, the assembly further includes a mechanism for maintaining the anchoring brackets 27 and the support panels 20 directly and statically abutted, without the use of intervening elements, against the existing pedal which is vital such that the vehicle pedal booster 10 is prohibited from disengaging the existing vehicle pedal during driving conditions. Such a maintaining mechanism 31 includes a plurality of rectilinear threaded fasteners 30 penetrating through the orifices 26 and engaging the anchoring brackets 27 respectively. Each of such fasteners 30 is registered orthogonally to respective longitudinal lengths of the anchoring brackets 27 and the support panel 20 which is crucial such that the anchoring brackets 27 remain fixedly spaced and juxtaposed posterior to the support panel 20 and the existing vehicle pedal respectively. The anchoring brackets 27 are fixed securedly around a vehicle pedal by a tightening the threaded fasteners 30 within the orifices 26 of the support panel 20. Such tightening procedures may require use of a special device 50, as shown in FIG. 3, which is designed specifically for use with the threaded fasteners 30.

The present invention, as claimed, provides the unexpected and unpredictable benefit of enabling users of shorter statures to easily reach an existing vehicle pedal. The anchoring brackets 27 provide the unexpected benefit of engaging the support panel 20 with the existing pedal 11, while also providing a mechanism 50 for easily installing or removing the assembly 10 as needed by a user. Such benefits overcome the prior art shortcomings.

In use, a method for assisting a driver of a vehicle to reach an existing vehicle pedal during driving conditions includes the step of providing a rigid support panel 20 has a rectilinear central region 21 has a predetermined thickness. Such a support panel 20 further has a corrugated top surface 22 provided with a plurality of juxtaposed linear ridges 23 traversing a longitudinal length of the top panel 22, and the body further has a plurality of flanges 24 monolithically formed with the support panel 20 and situated at opposed corners thereof respectively. Each of such flanges 24 has an axial orifice formed therein and spanning through an entire thickness of the associated flanges 24.

In use, the steps further include: spacing a plurality of anchoring brackets 27 from the support panel 20 by positioning the anchoring brackets 27 posterior of the support panel 20 in such a manner that the existing vehicle pedal 11 is intercalated between the anchoring brackets 27 and the support panel 20; and maintaining the anchoring brackets 27 and the support panels 20 directly and statically abutted, without the use of intervening elements, against the existing pedal 11 such that the vehicle pedal booster 10 is prohibited from disengaging the existing vehicle pedal 11 during driving conditions.

In use, the method further includes the step of penetrating a plurality of rectilinear threaded fasteners 30 through the orifices 26 and engaging the anchoring brackets 27 respectively. Each of such fasteners 30 is registered orthogonally to respective longitudinal lengths of the anchoring brackets 27 and the support panel 20 such that the anchoring brackets 27 remain fixedly spaced and juxtaposed posterior to the support panel 20 and the existing vehicle pedal 11 respectively.

In use, the method further includes the steps of: engaging a plurality of protrusions 28 of each of the anchoring brackets 27 and the support panel 20 with the existing vehicle pedal 11; and directly abutting, without the use of intervening elements, a planar top surface 29 of each of the anchoring brackets 27 against a bottom surface of the existing vehicle pedal 11. The anchoring brackets 27 have corresponding longitudinal lengths registered parallel to a bottom surface of the support panel 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A vehicle pedal booster for assisting a driver of a vehicle to reach an existing vehicle pedal during driving conditions, said vehicle pedal booster comprising:

a rigid support panel having a rectilinear central region provided with a predetermined thickness, said support panel further having a corrugated top surface provided with a plurality of juxtaposed linear ridges traversing a longitudinal length of said top panel, said body further having a plurality of flanges monolithically formed with said support panel and situated at opposed corners thereof respectively, each of said flanges having an axial orifice formed therein and spanning through an entire thickness of said associated flanges;

a plurality of anchoring brackets spaced from said support panel and positioned posterior thereof in such a manner that the existing vehicle pedal is intercalated between said anchoring brackets and said support panel; and means for maintaining said anchoring brackets and said support panels directly and statically abutted against the existing pedal such that said vehicle pedal booster is prohibited from disengaging the existing vehicle pedal during driving conditions;

wherein said maintaining means comprises: a plurality of rectilinear threaded fasteners penetrating through said orifices and engaging said anchoring brackets respectively, each of said fasteners being registered orthogonally to respective longitudinal lengths of said anchoring brackets and said support panel such that said anchoring brackets remain fixedly spaced and juxtaposed posterior to said support panel and the existing vehicle pedal respectively;

wherein said flanges are monolithically formed with said support panel and are coplanar with said with a top surface of said support panel;

wherein said axial orifices are registered orthogonally to said top surface of said support panel;

wherein said flanges are outwardly spaced from opposed lateral ends of said top surface of said support panel;

wherein an entire longitudinal length of each of said fasteners is rectilinear and linearly travels along a linear path beginning from said axial orifices and terminating at said anchoring brackets respectively.

2. The vehicle pedal booster of claim 1, wherein each of said anchoring brackets and said support panel have a surface provided with a plurality of protrusions extending outwardly therefrom for providing an increased surface area against which the existing vehicle pedal is engaged.

3. The vehicle pedal booster of claim 1, wherein each of said anchoring brackets have planar top surfaces directly abutted against a bottom surface of the existing vehicle pedal, said anchoring brackets having corresponding longitudinal lengths registered parallel to a bottom surface of said support panel.

4. The vehicle pedal booster of claim 1, wherein each of said anchoring brackets are independently adaptable along a corresponding rectilinear path defined along respective longitudinal lengths of said fasteners such that said vehicle pedal booster maintains direct contact with the existing vehicle pedal.

5. The vehicle pedal booster of claim 1, wherein said top surface of said support panel is formed from rubber material for preventing a user's foot from slipping off of said support panel.

6. A method for assisting a driver of a vehicle to reach an existing vehicle pedal during driving conditions, said method comprising the steps of:

a. providing a rigid support panel having a rectilinear central region having a predetermined thickness, said support panel further having a corrugated top surface provided with a plurality of juxtaposed linear ridges traversing a longitudinal length of said top panel, said body further having a plurality of flanges monolithically formed with said support panel and situated at opposed corners thereof respectively, each of said flanges having an axial orifice formed therein and spanning through an entire thickness of said associated flanges;

b. spacing a plurality of anchoring brackets from said support panel by positioning said anchoring brackets posterior of said support panel in such a manner that the existing vehicle pedal is intercalated between said anchoring brackets and said support panel; and c. maintaining said anchoring brackets and said support panels directly and statically abutted against the existing pedal such that said vehicle pedal booster is prohibited from disengaging the existing vehicle pedal during driving conditions;

wherein said flanges are monolithically formed with said support panel and are coplanar with said with a top surface of said support panel;

wherein said axial orifices are registered orthogonally to said top surface of said support panel;

wherein said flanges are outwardly spaced from opposed lateral ends of said top surface of said support panel;

wherein an entire longitudinal length of each of said fasteners is rectilinear and linearly travels along a linear path beginning from said axial orifices and terminating at said anchoring brackets respectively.

7. The method of claim 6, wherein step c. comprises the steps of:

i. penetrating a plurality of rectilinear threaded fasteners through said orifices and engaging said anchoring brackets respectively, each of said fasteners being registered orthogonally to respective longitudinal lengths of said anchoring brackets and said support panel such that said anchoring brackets remain fixedly spaced and juxtaposed posterior to said support panel and the existing vehicle pedal respectively.

8. The method of claim 6, wherein step c. comprises the step of:

engaging a plurality of protrusions of each of said anchoring brackets and said support panel with the existing vehicle pedal.

9. The method of claim 6, wherein step b. comprises the step of:

directly abutting a planar top surface of each of said anchoring brackets against a bottom surface of the existing vehicle pedal, said anchoring brackets having corresponding longitudinal lengths registered parallel to a bottom surface of said support panel.

10. The method of claim 6, wherein step c. comprises the steps of:

independently adapting each of said anchoring brackets along a corresponding rectilinear path defined along respective longitudinal lengths of said fasteners such that said vehicle pedal booster maintains direct contact with the existing vehicle pedal.

11. The method of claim 6, wherein said top surface of said support panel is formed from rubber material for preventing a user's foot from slipping off of said support panel.

* * * * *